US012286690B2

(12) United States Patent
Maeda et al.

(10) Patent No.: US 12,286,690 B2
(45) Date of Patent: Apr. 29, 2025

(54) Ni—Cr—Mo—Nb ALLOY

(71) Applicant: Nippon Yakin Kogyo Co., Ltd., Tokyo (JP)

(72) Inventors: Taiki Maeda, Kawasaki (JP); Fugao Wei, Kawasaki (JP)

(73) Assignee: Nippon Yakin Kogyo Co., Ltd., Tokyo (JP)

( * ) Notice: Subject to any disclaimer, the term of this patent is extended or adjusted under 35 U.S.C. 154(b) by 429 days.

(21) Appl. No.: 17/913,625

(22) PCT Filed: Mar. 31, 2021

(86) PCT No.: PCT/JP2021/013955

§ 371 (c)(1),
(2) Date: Sep. 22, 2022

(87) PCT Pub. No.: WO2021/201142

PCT Pub. Date: Oct. 7, 2021

(65) Prior Publication Data

US 2023/0151458 A1 May 18, 2023

(30) Foreign Application Priority Data

Apr. 3, 2020 (JP) ..... 2020-067349

(51) Int. Cl.

| | |
|---|---|
| ***C22C 19/05*** | (2006.01) |
| ***C22C 1/02*** | (2006.01) |
| ***C22C 19/00*** | (2006.01) |
| ***C22C 32/00*** | (2006.01) |
| ***C22F 1/10*** | (2006.01) |

(52) U.S. Cl.
CPC ..... *C22C 19/055* (2013.01); *C22C 19/007* (2013.01); *C22C 32/0047* (2013.01); *C22C 1/023* (2013.01); *C22F 1/10* (2013.01)

(58) Field of Classification Search
CPC . C22C 19/055; C22C 19/007; C22C 32/0047; C22C 1/023; C22F 1/10
See application file for complete search history.

(56) References Cited

U.S. PATENT DOCUMENTS

| | | | | |
|---|---|---|---|---|
| 4,765,956 | A | 8/1988 | Smith et al. | |
| 10,513,756 | B2 | 12/2019 | Kikutake et al. | |
| 2001/0012491 | A1* | 8/2001 | Strietzel | A61K 6/842 420/452 |
| 2016/0355911 | A1* | 12/2016 | Jotoku | C22C 38/46 |
| 2019/0055627 | A1* | 2/2019 | Nagatomi | C22C 19/055 |
| 2019/0078178 | A1 | 3/2019 | Kikutake et al. | |
| 2020/0392611 | A1* | 12/2020 | Jotoku | B23K 35/40 |
| 2020/0392612 | A1* | 12/2020 | Takagi | C22C 1/023 |

FOREIGN PATENT DOCUMENTS

| | | | |
|---|---|---|---|
| JP | S61-153251 | A | 7/1986 |
| JP | S63-050440 | A | 3/1988 |
| JP | 2015-183290 | A | 10/2015 |
| JP | 2019-039021 | A | 3/2019 |
| JP | 2019-052349 | A | 4/2019 |
| WO | 2019/107456 | A1 | 6/2019 |

OTHER PUBLICATIONS

Jun. 22, 2021 International Search Report issued in International Patent Application No. PCT/JP2021/013955.
Sep. 21, 2021 International Preliminary Report on Patentability issued in International Patent Application No. PCT/JP2021/013955.
Jul. 10, 2020 Office Action issued in Japanese Patent Application No. 2020-067349.
Sep. 24, 2020 Office Action issued in Japanese Patent Application No. 2020-067349.

* cited by examiner

*Primary Examiner* — Adil A. Siddiqui
(74) *Attorney, Agent, or Firm* — Oliff PLC

(57) ABSTRACT

A Ni—Cr—Mo—Nb alloy consists of, in mass %, C: not more than 0.020%, Si: 0.02 to 1.0%, Mn: 0.02 to 1.0%, P: not more than 0.03%, S: not more than 0.005%, Cr: 18.0 to 24.0%, Mo: 8.0 to 10.0%, Al: 0.005 to 0.4%, Ti: 0.1 to 1.0%, Fe: not more than 5.0%, Nb: 2.5 to 5.0%, N: 0.002 to 0.02%, and at least one of W: 0.02 to 0.3% and V: 0.02 to 0.3%, and Ni as a remainder and inevitable impurities, in which an freely selected cross section of alloy, sum of number of particles of NbC carbide and (Ti, Nb)N nitride is 100 to 1000 particles/mm$^2$, number of particles of the NbC carbide is not more than 40 particles/mm$^2$, and number of particles of the (Ti, Nb)N nitride is 100 to 1000 particles/mm$^2$.

8 Claims, No Drawings

Ni—Cr—Mo—Nb ALLOY

TECHNICAL FIELD

The present invention relates to Ni—Cr—Mo—Nb alloy which is used in conditions requiring corrosion resistance, such as in chemical plants, pipe arrangements and containers for natural gas, and the like.

BACKGROUND ART

Ni—Cr—Mo—Nb alloy is a Ni-based alloy having extremely superior corrosion resistance. Therefore, it is widely used as a material for, for example, chemical plants, natural gas fields, and oil fields, which are highly corrosive environments. When the alloy is used in such fields, it is necessary to be processed in many ways. Therefore, it is necessary that a 0.2% proof stress, which is a stress at which plastic deformation starts, be set at an appropriate value. With respect to such requirements, inventions for various types of techniques used with Ni—Cr—Mo—Nb alloys, which were disclosed in the past, are explained below.

As mentioned above, Ni—Cr—Mo—Nb alloy is used in heavy uses requiring corrosion resistance such as chemical plants or natural gas plants. Therefore, surface corrosion resistance is important. Therefore, formation of dense passivation films on surfaces (see Patent Document 1, for example), and techniques for controlling carbides affecting corrosion resistance (see Patent Document 2, for example) have been disclosed.

Furthermore, results of research about fatigue strength and tensile strength of Ni—Cr—Mo—Nb alloy are disclosed (see Patent Document 3, for example). However, in these techniques, there is no disclosure about how the 0.2% proof stress is controlled.

In addition, techniques in which rare earth elements are added so as to improve hot workability have been disclosed (see Patent Document 4, for example). However, there are no disclosures about workability at room temperature.

Furthermore, recently, a document has disclosed that if (Ti, Nb) N having a MgO inclusion as a nucleus is generated in a melt alloy, surface defects are thereby formed in a cold rolled plate (Patent Document 5, for example). In this research, although minor components such as Mg and Ca are controlled so that Ni—Cr—Mo—Nb alloy having superior surface cleanness is provided, there is no disclosure about 0.2% proof stress.

The 0.2% proof stress is an important property as a mechanical property; however, as mentioned above, a technique in which this mechanical property is controlled in a certain range has not actually yet been suggested.

Patent Document 1: Japanese Unexamined Patent Application Publication No. 2015-183290

Patent Document 2: Japanese Unexamined Patent Application Publication No. 2019-52349

Patent Document 3: Japanese Unexamined Patent Application Publication No. Showa 63 (1988)-50440

Patent Document 4: Japanese Unexamined Patent Application Publication No. Showa 61 (1986)-153251

Patent Document 5: Japanese Unexamined Patent Application Publication No. 2019-39021

SUMMARY OF INVENTION

As mentioned above, no technique controlling 0.2% proof stress has yet actually been completed. Therefore, an object of the present invention is to provide Ni—Cr—Mo—Nb alloy having controlled 0.2% proof stress by controlling distribution of carbides and nitrides and setting crystal grain diameter distribution within an appropriate range.

The inventors have researched to solve the above. In a laboratory, Ni—Cr—Mo—Nb alloys each having different composition were melted in a 20 kg size high frequency induction furnace, and encased in a mold so as to obtain an alloy ingot. Each of the alloys was hot-forged so as to obtain forged material having a thickness of 6 mm, and was cold-rolled so as to obtain a cold-rolled plate having a thickness of 2 mm. These cold-rolled materials were heat-treated so as to obtain sample materials for types of observing and testing. First, a flat tensile test piece defined in Japanese Industrial Standards (JIS) No. 13B was cut out so as to perform tensile testing, and 0.2% proof stress was obtained. Furthermore, using FE-SEM, microstructure and precipitations in alloy cross section were observed. During these experiments, the following knowledge was obtained.

That is, the knowledge was obtained that in order to control 0.2% proof stress of Ni—Cr—Mo—Nb alloy within 270 to 400 MPa, secondary particles are necessary, which restrains excessive growth of crystal grains in a range of 1150 to 1220° C. of final annealing temperature.

Researching about which particle is appropriate, first, it became clear that a prime candidate NbC cannot be used because it solid-solves. Next, as a result of focusing on nitrides, it became clear that (Ti, Nb)N nitride is the most effective.

That is, the knowledge was obtained that (Ti, Nb)N nitride which is contained stably and is not solid-solved in heat treatment at 1150 to 1220° C. is the most effective.

Furthermore, it became clear that to restrain excessive growth of crystal grains, at least 100 particles/mm$^2$ is necessary, thereby enabling maintaining a lower limit value of 270 MPa of 0.2% proof stress. On the other hand, it became clear that 0.2% proof stress value is more than 400 MPa if the number of particles of nitride is greater than 1000 particles/mm$^2$. In this way, the present invention was completed by way of experiments, and the claims of the present invention are as follows.

In an aspect of the present invention, a Ni—Cr—Mo—Nb alloy consists of, in mass %, C: not more than 0.020%, Si: 0.02 to 1.0%, Mn: 0.02 to 1.0%, P: not more than 0.03%, S: not more than 0.005%, Cr: 18.0 to 24.0%, Mo: 8.0 to 10.0%, Al: 0.005 to 0.4%, Ti: 0.1 to 1.0%, Fe: not more than 5.0%, Nb: 2.5 to 5.0%, N: 0.002 to 0.02%, and at least one of W: 0.02 to 0.3% and V: 0.02 to 0.3%, and Ni as a remainder and inevitable impurities, in which in a freely selected cross section of alloy, the sum of the number of particles of NbC carbide and (Ti, Nb)N nitride is 100 to 1000 particles/mm$^2$, the number of particles of NbC carbide is not greater than 40 particles/mm$^2$, and the number of particles of the (Ti, Nb)N nitride is 100 to 1000 particles/mm$^2$.

It is desirable that Nb in the (Ti, Nb)N nitride be 5.0 to 40%. Furthermore, it is desirable that average particle diameter of the nitride be 0.10 to 3.00 μm.

It is desirable that crystal grain diameter have the following crystal grain diameter distribution, that is, 1 μm to less than 20 μm is not more than 10%, 20 μm to less than 40 μm is not more than 20%, 40 μm to less than 60 μm is not more than 30%, 60 μm to less than 80 μm is 15 to 40%, 80 μm to less than 100 μm is 15 to 40%, 100 μm to less than 120 μm is 10 to 90%, and not less than 120 μm is not more than 30%.

By this, 0.2% proof stress can be controlled to within 270 to 400 MPa.

EMBODIMENTS OF INVENTION

Hereinafter reasons for limitation of chemical compositions of Ni—Cr—Mo—Nb alloys of the present invention are explained. It should be noted that "%" means "mass %" in all cases.

C: Not More than 0.020%

C is an important element in the present invention. If C is highly contained at greater than 0.020%, C combines with Nb during solidification of melt alloy so as to form NbC. However, NbC has a property of solid-solving during final annealing, which is desirably performed in a temperature range of 1150 to 1220° C. Therefore, the number of particles of NbC will be small, being not more than 40 particles/mm$^2$ in a freely chosen cross section of alloy, and by this phenomenon, particle growth is extremely promoted during heat treatment, and thus, this is harmful carbide. That is, crystal grain diameter distribution is shifted to coarsening, being out of range of the present invention. As a result, 0.2% proof stress becomes low, being less than 270 MPa. Therefore, it is necessary to reduce formation of NbC as much as possible.

In addition, if Nb and C are combined so as to form a large amount of NbC, Nb is consumed by this formation of carbide. As will be explained later in detail, since formation of (Ti, Nb)N nitride, which is an effective nitride in the present invention, is inhibited, and it is necessary to limit C to be not more than 0.020%.

Furthermore, at a heat-affected portion by heat treatment or welding, C will combine with Cr and Mo, which are effective for maintaining corrosion resistance so as to form carbides easily. A Cr and Mo-depleted layer will be formed around these carbides, thereby decreasing necessary corrosion resistance.

It should be noted that since C has an effect of increasing strength by solid-solving in alloy, which is not limited in particular, it is desirable to contain not less than 0.002%. As explained so far, C is limited to not more than 0.020%. It is desirably not more than 0.015%, and more desirably 0.002 to 0.015%. It is most desirably 0.002 to 0.010%.

Si: 0.02 to 1.0%

Since Si is an element effective for deoxidation, not less than 0.02% is necessary. However, since Si is an element promoting formation of M6C (M is mainly Mo, Ni, Cr, Si) and M23C6 (M is mainly Cr, Mo, Fe) and deteriorating grain-boundary corrosion resistance, it must be reduced to not more than 1.0%. Therefore, Si is limited to be 0.02 to 1.0%.

Mn: 0.02 to 1.00%

Since Mn is an element effective for deoxidation, not less than 0.02% is necessary. However, since Mn is an element promoting formation of MnS and reducing pitting resistance, it is necessary that it be not more than 1.0%. Therefore, Mn is limited to be 0.02 to 1.00%.

P: Not More than 0.03%

Since P is an element reducing hot workability, it is desirable to be reduced. Therefore, P is limited to be not more than 0.03%.

S: Not More than 0.005%

Since S is an element reducing hot workability in the same way as P and reducing corrosion resistance by forming MnS, it is desirable to be reduced as much as possible. Therefore, S is limited to be not more than 0.005%.

Cr: 18.0 to 24.0%

Cr is a very important element since Cr forms a passivation film on the surface of an alloy to maintain corrosion resistance. However, since excessive addition of Cr promotes precipitation of M23C6, corrosion resistance may be deteriorated. Therefore, Cr is limited to be 18.0 to 24.0%.

Mo: 8.0 to 10.0%

Mo is an important element to form a passivation film and to maintain corrosion resistance in the same way as Cr. However, excessive addition of Mo promotes precipitation of M6C and deteriorates corrosion resistance. Therefore, Mo is limited to be 8.0 to 10.0%.

Al: 0.005 to 0.4%

Al is an important element for deoxidation and desulfuration, and at least 0.005% is required. However, there are risks of formation of alumina clusters and generation of defects on the surface of an alloy plate by excessive addition. Therefore, Al is set to 0.005 to 0.4%.

Ti: 0.1 to 1.0%

Ti is a very important element in the present invention. That is, Ti is an element which combines nitrogen together with Nb mentioned below so that (Ti, Nb)N nitride having beneficial effect in the present invention is formed. (Ti, Nb)N nitride is formed in solidification of a melt alloy, is distributed in an alloy without being solid-solved even at a temperature of 1150 to 1220° C., and has an action to restrain crystal grain growth in the alloy. Therefore, crystal grain diameter distribution can be controlled in the range of the present invention. As a result, 0.2% proof stress can be controlled to be in 270 to 400 MPa. That is, in a case in which Ti content is low, being less than 0.1%, the number of particles of (Ti, Nb)N nitride becomes low, being less than 100 particles/mm$^2$ at a freely selected cross section, crystal grain diameter distribution is shifted to coarsening, and 0.2% proof stress is decreased, being less than 270 MPa. Therefore, it is necessary to contain at least 0.1% of Ti.

On the other hand, in a case in which Ti content is high, being more than 1.0%, the number of particles of (Ti, Nb)N nitride increases, being more than 1000 particles/mm$^2$ at a freely chosen cross section. By this phenomenon, growth of crystal grains is inhibited, crystal grain diameter distribution is shifted to being finer, and 0.2% proof stress is increased to more than 400 MPa. Therefore, Ti is set to be 0.1 to 1.0%. It is desirably 0.13 to 0.80% and more desirably, 0.15 to 0.70%.

Nb: 2.5 to 5.0%

Nb is also a very important element in the present invention, similar to Ti. That is, as mentioned above, Nb has actions of forming (Ti, Nb)N nitride together with Ti and restraining crystal grain growth during heat treatment. By this action, since crystal grain diameter distribution can be appropriately set, addition of not less than 2.5% is necessary. On the other hand, in a case in which much Nb is added, being more than 5.0%, nitride is formed at more than 1000 particles/mm$^2$ in a freely chosen cross section. In this way, crystal grains are prevented from growing, crystal grain diameter distribution is shifted to being finer, and 0.2% proof stress is high, being more than 400 MPa.

Furthermore, in a case in which more than 5.0% Nb is added, a temperature at which ductility is exhibited is decreased and hot workability is decreased. Therefore, Nb is set to be 2.5 to 5.0%. It is desirably 2.6 to 4.7%. It is more desirably 2.9 to 4.5%.

N: 0.002 to 0.02%

N combines Ti and Nb so as to form (Ti, Nb)N nitride, and enables satisfying range of crystal grain diameter distribution of the present invention as mentioned in the effect of Ti and Nb. As a result, 0.2% proof stress can be controlled to be 270 to 400 MPa. Therefore, N is set to be 0.002 to 0.02%. It is desirably 0.002 to 0.017%. It is more desirably 0.002 to 0.014%.

Fe: Not More than 5.0%

Fe is added to reduce production cost; however, since excessive addition may cause deterioration of corrosion resistance, Fe content is set to be not more than 5.0%.

W: Not More than 0.3%

W has an effect to increase strength; however, excessive addition may cause formation of carbides and deterioration of corrosion resistance, W content is set to be not more than 0.3%.

V: Not More than 0.3%

V has an effect of increasing strength by solid-solution; however, since excessive addition may cause formation of carbides and deterioration of corrosion resistance, V content is set to be not more than 0.3%.

In addition, a reason for limiting numbers of particles of NbC carbide and (Ti, Nb)N nitride in the present invention is explained. It should be noted that number distribution below is a number in a freely chosen cross section of alloy.

Sum of Numbers of Particles of NbC Carbide and (Ti, Nb)N Nitride: 100 to 1000 Particles/mm$^2$ A secondary particle is necessary to restrain excessive growth of crystal grains during heat treatment at 1150 to 1220° C. In order to restrain excessive growth of crystal grains, at least 100 particles/mm$^2$ is necessary, and by this, the lower limit value 270 MPa of 0.2% proof stress can be maintained. On the other hand, in a case of more than 1000 particles/mm$^2$, 0.2% proof stress value is more than 400 MPa.

NbC Carbide: Not More than 40 Particles/Mm$^2$

As explained above, Nb combines C during solidification of melt alloy to form NbC. However, NbC has a characteristic of being solid-solved during heat treatment at 1150 to 1220° C. Therefore, since it has unstable characteristics as a secondary particle, it is difficult to control its number distribution. Therefore, it is difficult to use it to restrain crystal grain growth.

By this phenomenon, there is an adverse effect in which crystal grains become too coarse. That is, since crystal grain diameter distribution is shifted to coarsening, NbC is a harmful carbide. As a result of crystal grain diameter distribution shifting to coarsening, 0.2% proof stress becomes low being less than 270 MPa.

In addition to the above explanation, the necessary element Nb, which forms (Ti, Nb)N nitride, which is good for controlling 0.2% proof stress within the range of the present invention, cannot be supplied to this nitride. Therefore, in the present invention, NbC is a harmful carbide.

Therefore, it is necessary to restrain formation of NbC as much as possible. Therefore, the number of particles of NbC in a freely chosen cross section of an alloy is set to be not more than 40 particles/mm$^2$. It is desirably set to be not more than 30 particles/mm$^2$. It is more desirably set to be not more than 20 particles/mm$^2$.

Number of Particles of (Ti, Nb)N Nitride: 100 to 1000 Particles/Mm$^2$

A secondary particle is necessary to restrain excessive growth of crystal grain during heat treatment at 1150 to 1220° C. In the present invention, as mentioned above, NbC cannot be utilized since NbC is solid-solved. In the present invention, it became clear that (Ti, Nb)N nitride is most effective. That is, (Ti, Nb)N nitride which is stably contained without being solid-solved during heat treatment at 1150 to 1220° C. is focused on. In order to restrain excessive growth of crystal grains, at least 100 particles/mm$^2$ is necessary, and by this, the lower limit value of 270 MPa of 0.2% proof stress can be maintained. On the other hand, in a case of more than 1000 particles/mm$^2$, 0.2% proof stress value may be more than 400 MPa. Therefore, the number of particles of (Ti, Nb)N nitride is set to be 100 to 1000 particles/mm$^2$. It is desirably set to be 110 to 900 particles/mm$^2$. It is more desirably set to be 140 to 900 particles/mm$^2$.

Next, a reason for limiting Nb amount in (Ti, Nb)N nitride, average particle diameter of nitride, and crystal grain diameter distribution, is explained.

Nb Amount in (Ti, Nb)N Nitride: 5.0 to 40%

In a case in which Nb amount in (Ti, Nb)N nitride is less than 5.0%, since distribution does not change very much even if (Ti, Nb)N nitride formed during solidification is treated by heat treatment at 1150 to 1220° C., the average particle diameter becomes relatively large. That is, even if the amount of N is the same, since the degree of dispersion of (Ti, Nb)N nitride is decreased, the number of particles of nitride decreases. By this, crystal grain diameter distribution is shifted to coarsening, and there is a tendency for 0.2% proof stress to be decreased.

On the other hand, in a case in which Nb amount in (Ti, Nb)N nitride is greater than 40%, after heat treatment at 1150 to 1220° C., in addition to (Ti, Nb)N nitride formed during solidification, NbC is solid-solved and precipitated as (Ti, Nb)N nitride again. Therefore, even if the amount of N is the same, there is a tendency for (Ti, Nb)N nitride to be dispersed. According to the effect, average particle diameter of nitride decreases, and the number of particles of (Ti, Nb)N nitride increases. As a result, crystal grain diameter distribution is shifted to being finer, and there is a tendency for 0.2% proof stress increases. Therefore, an embodiment is desirable in which Nb amount in (Ti, Nb)N nitride is 5 to 40%. It should be noted that amounts of Ti, Nb, and N should be controlled within the range of the present invention in order to satisfy Nb amount of 5 to 40% in (Ti, Nb)N nitride.

Average Particle Diameter of Nitride: 0.10 to 3.00 μm

As mentioned above, in a case in which Nb amount in (Ti, Nb)N nitride is less than 5%, since distribution does not change very much even if (Ti, Nb)N nitride formed during solidification is treated by heat treatment at 1150 to 1220° C., average particle diameter is relatively large, being more than 3.00 μm. Then, even if the amount of N is the same, the since degree of dispersion of (Ti, Nb)N nitride is decreased, the number of particles of nitride is reduced. By this, crystal grain particle distribution is shifted to coarsening, and there is a tendency for 0.2% proof stress to be decreased.

On the other hand, in a case in which Nb amount in (Ti, Nb)N nitride is greater than 40%, after heat treatment at 1150 to 1220° C., in addition to (Ti, Nb)N nitride formed during solidification, NbC is solid-solved and precipitated as (Ti, Nb)N nitride again. Therefore, even if the amount of N is the same, there is a tendency for (Ti, Nb)N nitride to be dispersed. According to this effect, average particle diameter of nitride particles becomes smaller, being less than 0.1 μm and the number of particles of (Ti, Nb)N nitride increases. As a result, crystal grain diameter distribution is shifted to being finer, and there is a tendency for 0.2% proof stress to increase. Therefore, an embodiment is desirable in which sizes of (Ti, Nb)N nitride particles are 0.1 to 3 μm. In order to satisfy this, as explained above, Nb amount in (Ti, Nb)N nitride should be 5 to 40%. It should be noted that amounts of Ti, Nb, and N should be controlled within the range of the present invention in order to satisfy Nb amount of 5 to 40% in (Ti, Nb)N nitride.

Crystal grain diameter distribution: 1 μm to less than 20 μm is not more than 10%, 20 μm to less than 40 μm is not more than 20%, 40 μm to less than 60 μm is not more than 30%, 60 μm to less than 80 μm is 15 to 40%, 80 μm to less than 100 μm is 15 to 40%, 100 μm to less than 120 μm is 10 to 90%, and not less than 120 μm is not more than 30%

Since a crystal grain boundary is a barrier to the movement of dislocation, crystal grain diameter distribution has a great effect on 0.2% proof stress. In a case in which a crystal grain diameter is large, the crystal grain boundary per a certain volume decreases, and the movement of dislocation is easier. According to this, 0.2% proof stress is a low value. On the other hand, in a case in which a crystal grain diameter is small, the crystal grain boundary per a certain volume increases, and the movement of dislocation is inhibited. Since larger stress is required for deformation, 0.2% proof stress is a large value. It should be noted that the crystal grain diameter defined here means area ratio of a crystal grain, except for a bicrystal grain boundary.

Considering the above, an embodiment is most desirable in which a crystal grain diameter distribution is 1 μm to less than 20 μm is not more than 10%, 20 μm to less than 40 μm is not more than 20%, 40 μm to less than 60 μm is not more than 30%, 60 μm to less than 80 μm is 15 to 40%, 80 μm to less than 100 μm is 15 to 40%, 100 μm to less than 120 μm is 10 to 90%, and not less than 120 μm is not more than 30%.

According to this, 0.2% proof stress can be controlled to be 270 to 400 MPa.

Although it is not limited in particular in the present invention, it is desirable that crystal grain diameter be controlled at the following heat treatment temperature.

Heat Treatment Temperature: 1150 to 1220° C.

At a low heat treatment temperature of less than 1150° C., since movement at a crystal grain boundary is difficult, growth of crystal grains is not promoted, and crystal grain diameter distribution is shifted to be finer, and there is a tendency for 0.2% proof stress to increase.

On the other hand, at a high heat treatment temperature being more than 1220° C., there is a tendency for not only NbC carbide, but also for (Ti, Nb)N nitride to be solid-solved. Therefore, since crystal grains become extremely coarse and crystal grain diameter distribution is shifted to coarsening, there is a tendency for 0.2% proof stress to be low. In addition, oxidation scale on the surface is formed thickly by unusual oxidation, and the scale is difficult to remove later. Therefore, in order to realize the above crystal grain diameter distribution and to set 0.2% proof stress to be 270 to 400 MPa, an embodiment is desirable in which heat treatment is performed at 1150 to 1220° C.

EXAMPLES

Hereinafter the present invention is explained further in detail by way of Examples.

In order to prepare alloys each having a chemical composition shown in Table 1, raw materials such as scrap, Ni, Cr, Mo and the like were melted in an electric furnace, and decarburization was performed by oxygen blowing by AOD (Argon Oxygen Decarburization) and/or VOD (Vacuum Oxygen Decarburization). After that, Al, limestone, and fluorite were added in order to form $CaO—SiO_2—Al_2O_3—MgO—F$ slag on melt alloy, so that deoxidation and desulfuration were performed. Furthermore, Nb, Ti were added, the composition was controlled, and the melt alloy was casted by a continuous casting apparatus, so that slabs each having a thickness 200 mm were obtained.

After that, each slab was hot rolled by a Steckel mill and was cold rolled, so as to produce a cold rolled plate. Table 1 shows chemical composition of each of the alloys, and Table 2 shows reduction of rolling, plate thickness, final annealing temperature, and evaluation result. It should be noted that the final annealing was performed for 4 minutes.

With respect to these sample materials, a cross section vertical to the rolled direction was cut out to have a thickness of 1 mm, the cross section was polished using a #800 polishing paper, and electrolytic polishing was performed for finishing. Each of the samples was evaluated by the following observations and measurements.

Number of Particles of NbC Carbide

First, by an energy dispersive X-ray spectroscopy (EDS) installed in a FE-SEM, NbC carbide existing was specified. Number of particles and particle size of NbC carbide specified in this way were obtained by FE-SEM, in a measurement in an area of 1 mm×1 mm.

Number of Particles of (Ti, Nb)N Nitride

First, by an energy dispersive X-ray spectroscopy (EDS) installed in a FE-SEM, (Ti, Nb)N nitride existing was specified. Number of particles and particle size of (Ti, Nb)N nitride specified in this way were obtained by FE-SEM, in a measurement in an area of 1 mm×1 mm.

Nb Amount in (Ti, Nb)N Nitride

Nb amount in (Ti, Nb)N nitride was obtained by an energy dispersive X-ray spectroscopy (EDS) installed in a FE-SEM, in a measurement in a range of 1 mm×1 mm.

Crystal Grain Diameter Distribution

Crystal grain diameter distribution was obtained by electron beam backscatter diffraction (EBSD) installed in a FE-SEM, in a measurement at ten locations in a region of 1000 $\mu m^2$.

Tensile Test

A flat tensile test piece as defined in Japanese Industrial Standards (JIS) No. 13B was cut out of the above cold rolled material in order for the tensile direction to be vertical to the rolled direction. Tensile tests were performed to obtain 0.2% proof stress.

Hereinafter Examples shown in Tables 1 and 2 are explained.

It should be noted that in the Tables, parentheses "( )" surround values not satisfying the range of the independent claim of the present invention, and brackets "[ ]" surround values satisfying the range of the independent claim, but not satisfying the range of the desirable dependent claims.

Since Nos. 1, 3, 4, 6 to 9, which are Examples of the present invention, all satisfy the desirable range of the present invention, they had appropriate microstructure, and they satisfied the range of 270 to 400 MPa of 0.2% proof stress by tensile tests. It should be noted that Nos. 2, 5, 10 to 13 to which*were added were almost good evaluation results; however, strictly speaking, since some of the properties were outside the range of the present invention, they were regarded as Reference Examples.

It should be noted that in the alloy of Example 3, Ti amount was high, but on the other hand, Nb amount was low and N amount was high. Therefore, number of particles of (Ti, Nb)N nitride was high, and Nb amount in (Ti, Nb)N nitride is out of the range, being 4%. Furthermore, particle size was large. As a result, crystal grain diameter distribution was shifted to being finer, and 0.2% proof stress was a relatively high value, being 385 MPa.

In the alloy of Example 5, since the C amount and N amount were low, number of particles of NbC was low and number of particles of (Ti, Nb)N nitride was also low. However, in total, not less than 100 particles/$mm^2$, which is the lower limit value of the range, could be maintained. As a result, crystal grain diameter distribution was shifted to coarsening, and 0.2% proof stress was a relatively low value, being 272 MPa.

In the alloy of Example 9, the C amount was high, and in addition, the Ti amount was low and the Nb amount was high. Therefore, the number of particles of NbC formed was high; however, the number of particles of NbC was not so great as to affect the number of particles of (Ti, Nb)N, and an appropriate number of particles could be maintained. In addition, the Nb amount in (Ti, Nb)N nitride was out of the range, being 41%. As a result, crystal grain diameter distribution was shifted to being finer, and 0.2% proof stress was a relatively high value, being 391 MPa.

In the alloys of Examples 10 to 13, since the N amount was low, the number of particles of NbC was low and the number of particles of (Ti, Nb)N nitride was also low. However, in total, not fewer than 100 particles/mm$^2$ which is the lower limit value of the range, could be maintained. As a result, crystal grain diameter distribution was shifted to coarsening, and 0.2% proof stress was a relatively low value, being 271 to 280 MPa.

Hereinafter Comparative Examples are explained.

In the alloy of Example 14, C amount was high, and the number of particles of NbC formed was far above the range. Therefore, the number of particles of (Ti, Nb)N was low, the Nb amount in (Ti, Nb)N was lower than the range and was outside of the present invention, the crystal grain diameter distribution was shifted to coarsening, and the 0.2% proof stress was below the range and was out of the range.

In the alloy of Example 15, since the Ti amount and the Nb amount were above the range and were out of the range, the number of particles of (Ti, Nb)N was higher than the range and was out of the range. Furthermore, Nb amount in (Ti, Nb)N was high, and sizes of nitride were below the range and were out of the range. Therefore, crystal grain diameter distribution was shifted to being finer, and 0.2% proof stress was higher than the range and was out of the range.

In the alloy of Example 16, since chemical composition Nb amount and was higher than the range and was out of the range, and heat treatment temperature was low, the number of particles of NbC was high, and the number of particles of (Ti, Nb)N was below the range and was out of the range. Furthermore, Nb amount in (Ti, Nb)N was high, and sizes of nitride were below the range and were out of the range. Therefore, crystal grain diameter distribution was shifted to coarsening, and 0.2% proof stress was below the range and was out of the range.

In the alloy of Example 17, N amount was low, number of particles of (Ti, Nb)N was below the range and was out of the range, crystal grain diameter distribution was shifted to coarsening, and 0.2% proof stress was below the range and was out of the range.

In the alloy of Example 18, since the Ti amount was lower and the Nb amount and the N amount were higher than the range and were out of the range, Nb amount in (Ti, Nb)N was higher than the range and was out of the range. Therefore, sizes of (Ti, Nb)N particles were below the range and were out of the range, and the number of particles of (Ti, Nb)N was higher than the range and was out of the range. As a result, crystal grain diameter distribution was shifted to being finer, and 0.2% proof stress was higher than the range and was out of the range.

In the alloy of Example 19, Nb amount and N amount were below the range and were out of the range. Furthermore, since annealing temperature was high, (Ti, Nb)N was coarse. Furthermore, number of particles of (Ti, Nb)N was below the range and was out of the range, crystal grain diameter distribution was shifted to coarsening, and 0.2% proof stress was below the range and was out of the range.

In the alloy of Example 20, since Ti amount was low, Nb amount in (Ti, Nb)N was higher than the range and was out of the range. Therefore, particle size of (Ti, Nb)N was below the range and was out of the range, and in addition, since C amount was relatively high, number of particles of NbC was higher and number of particles of (Ti, Nb)N was lower than the range and was out of the range. As a result, crystal grain diameter distribution was shifted to coarsening, and 0.2% proof stress was below the range and was out of the range.

In the alloy of Example 21, since Ti amount was high and Nb amount and N amount were low, Nb amount in (Ti, Nb)N was below the range and was out of the range. Size of (Ti, Nb)N particle was higher and its number of particles was below the range and was out of the range. Therefore, crystal grain diameter distribution was shifted to coarsening, and 0.2% proof stress was below the range and was out of the range.

In the alloy of Example 22, Nb amount and N amount were below the range and were out of the range, and number of particles of (Ti, Nb)N was below the range and was out of the range. As a result, crystal grain diameter distribution was shifted to coarsening, and 0.2% proof stress was below the range and was out of the range.

In the alloy of Example 23, since the N amount was higher than the range and was out of the range, the number of particles of (Ti, Nb)N was higher than the range and was out of the range. As a result, crystal grain diameter distribution was shifted to being finer, and 0.2% proof stress was higher than the range and was out of the range.

TABLE 1

| | Steel | Chemical compositions mass % remainder Ni | | | | | | | | | | | | | |
|---|---|---|---|---|---|---|---|---|---|---|---|---|---|---|---|
| Division | No. | C | Si | Mn | P | S | Cr | Mo | Al | Ti | Fe | Nb | N | W | V |
| Examples | 1 | — | 0.16 | 0.23 | 0.008 | 0.0008 | 23.06 | 8.32 | 0.120 | 0.68 | 4.33 | 3.11 | 0.012 | 0.08 | 0.02 |
| | * 2 | 0.012 | 0.12 | 0.13 | 0.012 | 0.0006 | 20.36 | 8.12 | 0.230 | 0.21 | 3.98 | 2.88 | 0.006 | — | — |
| | 3 | 0.011 | 0.22 | 0.31 | 0.023 | 0.0004 | 20.88 | 8.47 | 0.220 | 0.85 | 4.29 | 2.58 | 0.018 | 0.09 | 0.03 |
| | 4 | 0.004 | 0.10 | 0.11 | 0.002 | 0.0001 | 22.19 | 9.12 | 0.009 | 0.18 | 3.52 | 3.25 | 0.008 | — | 0.10 |
| | * 5 | 0.009 | 0.15 | 0.12 | 0.003 | 0.0001 | 22.25 | 8.35 | 0.015 | 0.15 | 2.53 | 3.12 | 0.003 | — | — |
| | 6 | 0.015 | 0.18 | 0.10 | 0.005 | 0.0003 | 22.02 | 8.36 | 0.352 | 0.78 | 1.23 | 2.98 | 0.016 | — | 0.10 |
| | 7 | 0.005 | 0.12 | 0.08 | 0.002 | 0.0004 | 18.89 | 9.28 | 0.238 | 0.34 | 1.35 | 3.02 | 0.009 | 0.02 | — |
| | 8 | 0.006 | 0.14 | 0.09 | 0.011 | 0.0025 | 22.31 | 8.11 | 0.190 | 0.25 | 4.47 | 3.36 | 0.013 | 0.13 | 0.12 |
| | 9 | 0.018 | 0.13 | 0.41 | 0.009 | 0.0004 | 21.98 | 8.09 | 0.260 | 0.12 | 4.67 | 4.81 | 0.012 | 0.06 | 0.09 |
| | * 10 | 0.007 | 0.15 | 0.12 | 0.003 | 0.0001 | 22.35 | 8.35 | 0.015 | 0.31 | 2.31 | 3.39 | 0.004 | — | — |
| | * 11 | 0.012 | 0.18 | 0.12 | 0.003 | 0.0002 | 22.25 | 8.36 | 0.019 | 0.41 | 3.61 | 2.91 | 0.002 | — | — |
| | * 12 | 0.011 | 0.15 | 0.14 | 0.004 | 0.0001 | 22.34 | 8.35 | 0.042 | 0.16 | 2.89 | 3.11 | 0.003 | — | — |
| | * 13 | 0.006 | 0.15 | 0.12 | 0.003 | 0.0001 | 22.19 | 8.35 | 0.022 | 0.19 | 2.31 | 3.28 | 0.005 | — | — |

TABLE 1-continued

| Division | Steel No. | Chemical compositions mass % remainder Ni | | | | | | | | | | | | | |
|---|---|---|---|---|---|---|---|---|---|---|---|---|---|---|---|
| | | C | Si | Mn | P | S | Cr | Mo | Al | Ti | Fe | Nb | N | W | V |
| Comparative Examples | 14 | (0.025) | 0.36 | 0.61 | 0.008 | 0.0005 | 23.72 | 8.11 | 0.160 | 0.89 | 4.23 | 3.21 | 0.011 | 0.06 | 0.03 |
| | 15 | — | 0.21 | 0.08 | 0.007 | 0.0004 | 22.3 | 8.26 | 0.230 | (1.52) | 3.31 | (5.52) | 0.013 | — | — |
| | 16 | 0.019 | 0.15 | 0.10 | 0.006 | 0.0006 | 22.37 | 8.61 | 0.262 | 0.23 | 4.13 | (5.23) | 0.008 | — | — |
| | 17 | 0.005 | 0.13 | 0.09 | 0.012 | 0.0005 | 22.51 | 8.12 | 0.124 | 0.15 | 2.34 | 2.63 | (0.001) | 0.10 | 0.3 |
| | 18 | 0.006 | 0.16 | 0.12 | 0.016 | 0.0005 | 22.91 | 8.31 | 0.271 | (0.05) | 3.82 | (5.82) | (0.035) | — | — |
| | 16 | — | 0.18 | 0.10 | 0.005 | 0.0003 | 22.02 | 8.36 | 0.352 | 0.85 | 1.23 | (2.35) | (0.001) | — | 0.10 |
| | 20 | 0.017 | 0.13 | 0.11 | 0.024 | 0.0009 | 20.54 | 8.61 | 0.180 | (0.09) | 4.21 | 4.91 | 0.005 | 0.08 | 0.04 |
| | 24 | 0.016 | 0.21 | 0.21 | 0.009 | 0.0007 | 21.98 | 8.21 | 0.250 | (1.12) | 4.95 | (2.22) | 0.005 | — | 0.01 |
| | 22 | — | 0.15 | 0.33 | (0.036) | 0.0007 | 19.11 | 8.01 | 0.230 | 0.11 | 4.61 | (2.30) | (0.001) | 0.04 | 0.02 |
| | 23 | — | 0.14 | 0.22 | 0.019 | 0.0006 | 22.60 | 8.73 | 0.320 | 0.23 | 4.88 | 2.51 | (0.029) | 0.09 | — |

TABLE 2

| Division | Steel No. | Rolling reduction % | Plate thickness mm | Annealing Temperature ° C. | NbC Particles/mm$^2$ | (Ti, Nb)N Particles/mm$^2$ | Sum of NbC and (Ti, Nb)N Particles/mm$^2$ | Nb content in (Ti, Nb)N mass % | Particle size μm |
|---|---|---|---|---|---|---|---|---|---|
| Examples | 1 | 98.0 | 4.0 | 1180 | 0 | 339 | 339 | 15 | 1.90 |
| | * 2 | 98.3 | 3.4 | 1190 | 19 | 246 | 265 | 19 | 1.70 |
| | 3 | 99.0 | 2.0 | 1185 | 16 | 982 | 998 | [4] | [3.20] |
| | 4 | 98.5 | 3.0 | 1200 | 0 | 125 | 125 | 25 | 1.96 |
| | * 5 | 97.0 | 6.0 | 1195 | 10 | (91) | 101 | 38 | 1.50 |
| | 6 | 97.9 | 4.2 | 1178 | 12 | 624 | 736 | 6 | 2.52 |
| | 7 | 98.6 | 2.8 | 1160 | 0 | 689 | 689 | 28 | 2.30 |
| | 8 | 98.3 | 3.4 | 1178 | 0 | 527 | 527 | 26 | 1.60 |
| | 9 | 98.6 | 2.8 | 1185 | 35 | 511 | 546 | [41] | [0.09] |
| | * 10 | 98.0 | 4.0 | 1175 | 6 | (98) | 104 | 31 | 1.72 |
| | * 11 | 97.5 | 5.0 | 1190 | 28 | (79) | 107 | 18 | 2.33 |
| | * 12 | 97.5 | 5.0 | 1170 | 10 | (90) | 100 | 31 | 1.73 |
| | * 13 | 97.3 | 5.4 | 1180 | 8 | (97) | 105 | 33 | 1.31 |
| Comparative Examples | 14 | 97.0 | 6.0 | 1175 | (41) | (58) | (99) | [3] | [3.12] |
| | 15 | 98.0 | 4.0 | 1180 | 0 | (1182) | (1182) | [46] | [0.06] |
| | 16 | 98.3 | 3.4 | [1110] | (48) | (40) | (88) | [42] | 0.80 |
| | 17 | 98.0 | 4.0 | 1180 | 0 | (11) | (11) | 39 | 1.60 |
| | 18 | 98.7 | 2.6 | 1160 | 13 | (2631) | (2644) | [65] | [0.02] |
| | 19 | 97.9 | 4.2 | [1250] | 0 | (3) | (3) | 23 | [4.50] |
| | 20 | 98.3 | 3.4 | 1170 | (46) | (43) | (89) | [42] | [0.03] |
| | 21 | 97.3 | 5.4 | 1180 | 16 | (82) | (98) | [4] | [3.30] |
| | 22 | 98.6 | 2.8 | 1176 | 0 | (30) | (30) | 16 | 1.60 |
| | 23 | 98.6 | 2.8 | 1182 | 0 | (2011) | (2011) | 17 | 2.10 |

| Division | Steel No. | 1~20 (μm) | 20~40 (μm) | 40~60 (μm) | 60~80 (μm) % | 80~100 (μm) | 100~120 (μm) | 120~ (μm) | 0.2% proof stress Mpa |
|---|---|---|---|---|---|---|---|---|---|
| Examples | 1 | 3 | 9 | 16 | 21 | 19 | 18 | 14 | 340 |
| | * 2 | 6 | 10 | 15 | 23 | 21 | 19 | 6 | 301 |
| | 3 | [12] | 13 | 28 | 26 | 17 | [4] | 0 | 385 |
| | 4 | 2 | 8 | 26 | 24 | 15 | 16 | 9 | 304 |
| | * 5 | 0 | 0 | 7 | 17 | 24 | 21 | [31] | 272 |
| | 6 | 7 | 12 | 15 | 26 | 21 | 17 | 2 | 321 |
| | 7 | 0 | 0 | 10 | 20 | 28 | 38 | 4 | 336 |
| | 8 | 0 | 14 | 21 | 20 | 17 | 15 | 13 | 339 |
| | 9 | [12] | 14 | 23 | 21 | 18 | 12 | 0 | 391 |
| | * 10 | 0 | 0 | 5 | 19 | 24 | 20 | [32] | 274 |
| | * 11 | 0 | 0 | 3 | 18 | 20 | 21 | [38] | 271 |
| | * 12 | 0 | 0 | 7 | 16 | 24 | 21 | [32] | 280 |
| | * 13 | 0 | 0 | 5 | 17 | 24 | 21 | [33] | 278 |
| Comparative Examples | 14 | 0 | 0 | 8 | 17 | 18 | 23 | [34] | 267 |
| | 15 | [16] | [38] | 28 | 18 | [0] | [0] | 0 | 435 |
| | 16 | 0 | 0 | 7 | [9] | 16 | 26 | [42] | 250 |
| | 17 | 0 | 0 | 0 | [12] | 19 | 26 | [43] | 248 |
| | 18 | [28] | [45] | 21 | [6] | [0] | [0] | 0 | 481 |
| | 19 | 3 | 6 | 7 | [9] | 19 | 22 | [34] | 251 |
| | 20 | 0 | 5 | 8 | [9] | [11] | 21 | [46] | 255 |
| | 21 | 0 | 0 | 5 | [13] | 17 | 25 | [40] | 223 |
| | 22 | 1 | 6 | 8 | [10] | [11] | 21 | [43] | 266 |
| | 23 | [38] | [43] | 13 | [6] | [0] | [0] | 0 | 443 |

The present invention can be used in industries having highly corrosive environments such as in chemical plants, natural gas plants, oil fields, and the like.

The invention claimed is:

1. A Ni—Cr—Mo—Nb alloy consisting of:

in mass %, C: not more than 0.020%, Si: 0.02 to 1.0%, Mn: 0.02 to 1.0%, P: not more than 0.03%, S: not more than 0.005%, Cr: 18.0 to 24.0%, Mo: 8.0 to 10.0%, Al: 0.005 to 0.4%, Ti: 0.1 to 1.0%, Fe: not more than 5.0%, Nb: 2.5 to 5.0%, N: 0.002 to 0.02%, and at least one of W: 0.02 to 0.3% and V: 0.02 to 0.3%, and Ni as a remainder and inevitable impurities, wherein in a freely selected cross section of alloy, a sum of number of particles of NbC carbide and number of particles of (Ti, Nb) N nitride is 100 to 1000 particles/$mm^2$, the number of particles of NbC carbide is not greater than 40 particles/$mm^2$, and the number of particles of (Ti, Nb) N nitride is 100 to 1000 particles/$mm^2$.

2. The Ni—Cr—Mo—Nb alloy according to claim 1, wherein Nb in the (Ti, Nb) N nitride is 5.0 to 40%.

3. The Ni—Cr—Mo—Nb alloy according to claim 2, wherein average particle diameter of the nitride is 0.10 to 3.00 μm.

4. The Ni—Cr—Mo—Nb alloy according to claim 3, wherein with respect to crystal grain diameter, 1 μm to less than 20 μm is not more than 10%, 20 μm to less than 40 μm is not more than 20%, 40 μm to less than 60 μm is not more than 30%, 60 μm to less than 80 μm is 15 to 40%, 80 μm to less than 100 μm is 15 to 40%, 100 μm to less than 120 μm is 10 to 90%, and not less than 120 μm is not more than 30%.

5. The Ni—Cr—Mo—Nb alloy according to claim 2, wherein with respect to crystal grain diameter, 1 μm to less than 20 μm is not more than 10%, 20 μm to less than 40 μm is not more than 20%, 40 μm to less than 60 μm is not more than 30%, 60 μm to less than 80 μm is 15 to 40%, 80 μm to less than 100 μm is 15 to 40%, 100 μm to less than 120 μm is 10 to 90%, and not less than 120 μm is not more than 30%.

6. The Ni—Cr—Mo—Nb alloy according to claim 1, wherein average particle diameter of the nitride is 0.10 to 3.00 μm.

7. The Ni—Cr—Mo—Nb alloy according to claim 6, wherein with respect to crystal grain diameter, 1 μm to less than 20 μm is not more than 10%, 20 μm to less than 40 μm is not more than 20%, 40 μm to less than 60 μm is not more than 30%, 60 μm to less than 80 μm is 15 to 40%, 80 μm to less than 100 μm is 15 to 40%, 100 μm to less than 120 μm is 10 to 90%, and not less than 120 μm is not more than 30%.

8. The Ni—Cr—Mo—Nb alloy according to claim 1, wherein with respect to crystal grain diameter, 1 μm to less than 20 μm is not more than 10%, 20 μm to less than 40 μm is not more than 20%, 40 μm to less than 60 μm is not more than 30%, 60 μm to less than 80 μm is 15 to 40%, 80 μm to less than 100 μm is 15 to 40%, 100 μm to less than 120 μm is 10 to 90%, and not less than 120 μm is not more than 30%.

* * * * *